US008241380B2

(12) United States Patent
Hoffer

(10) Patent No.: US 8,241,380 B2
(45) Date of Patent: Aug. 14, 2012

(54) AIR FILTER DUCT COVER

(76) Inventor: Mary Lou Hoffer, So. Glens Falls, NY (US)

( * ) Notice: Subject to any disclaimer, the term of this patent is extended or adjusted under 35 U.S.C. 154(b) by 471 days.

(21) Appl. No.: 12/271,929

(22) Filed: Nov. 17, 2008

(65) Prior Publication Data

US 2009/0126679 A1 May 21, 2009

Related U.S. Application Data

(60) Provisional application No. 60/988,890, filed on Nov. 19, 2007.

(51) Int. Cl.
*B01D 46/00* (2006.01)

(52) U.S. Cl. ..... 55/481; 55/493; 55/506

(58) Field of Classification Search ..... 55/492, 55/495–497, 499, 501, 502, DIG. 31, 481, 55/493, 505, 506, 418, 467, 490; 123/198 E
See application file for complete search history.

(56) References Cited

U.S. PATENT DOCUMENTS

| | | | | | |
|---|---|---|---|---|---|
| 3,246,456 | A * | 4/1966 | Sharp | 55/481 |
| 3,422,482 | A * | 1/1969 | Hamrick | 15/314 |
| 3,494,113 | A * | 2/1970 | Kinney | 55/481 |
| 3,793,813 | A * | 2/1974 | McAllister | 55/481 |
| 4,784,675 | A * | 11/1988 | Leber et al. | 96/110 |
| 5,458,667 | A * | 10/1995 | Poggi et al. | 55/480 |
| 5,944,860 | A * | 8/1999 | Mack et al. | 55/492 |
| 6,264,713 | B1 * | 7/2001 | Lewis, II | 55/481 |
| 6,387,164 | B1 * | 5/2002 | Cheng | 96/66 |
| 6,425,945 | B1 * | 7/2002 | Cheng | 96/66 |
| 6,843,820 | B2 * | 1/2005 | Kubokawa | 55/495 |
| 6,875,250 | B2 * | 4/2005 | Terlson | 55/497 |
| 7,090,713 | B2 * | 8/2006 | Terlson | 55/495 |
| 2003/0150196 | A1 * | 8/2003 | Duffy | 55/385.2 |

* cited by examiner

*Primary Examiner* — Duane Smith
*Assistant Examiner* — Karla Hawkins
(74) *Attorney, Agent, or Firm* — Michael Ries

(57) ABSTRACT

Disclosed is a way to increase the air circulation in buildings with furnaces, air conditioners, etc. with ducts that have openings on filter holders for filters. The present invention would stop the air from being drawn in around the filter opening causing more air being drawn from the return vents to increase circulation.

5 Claims, 5 Drawing Sheets

AIR FILTER DUCT COVER

This application claims priority to U.S. Provisional Application 60/988,890 filed 19 Nov. 2007, the entire disclosure of which is incorporated by reference.

TECHNICAL FIELD AND BACKGROUND

The present invention relates to air filter duct covers. More specifically the present invention would seal out air around filter holders.

The present invention has two parts. There are two sides open on a duct filter holder where filters can be placed. One part of the present invention would be just a flat piece of metal or plastic with a foam strip to seal around one side of the duct screwed on over the opening. The other part would protrude from the duct with hinges and a catch or latch again there would be a foam seal around the other side of the duct with hinges and a latch or catch to allow replacement of a filter.

In the present invention the two pieces work together by sealing out air that is causing the loss in circulation due to the filter holders on the ducts having openings with no covers. Air duct filter holders with only one opening to replace a filter, the protruding part works alone to seal out air.

The present invention can be made of plastic or metal. Many different seals, hinges or catches can be used. Hinges and catches or catch can be on the protruding part or flat part. The present device can be formed to fit different size filter holders or the cover may be adjustable to fit many different size filter holders.

BRIEF DESCRIPTION OF THE DRAWINGS

The objects, features, and advantages of the present invention will be apparent from the following detailed description of the preferred embodiment of the invention with references to the following drawings.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
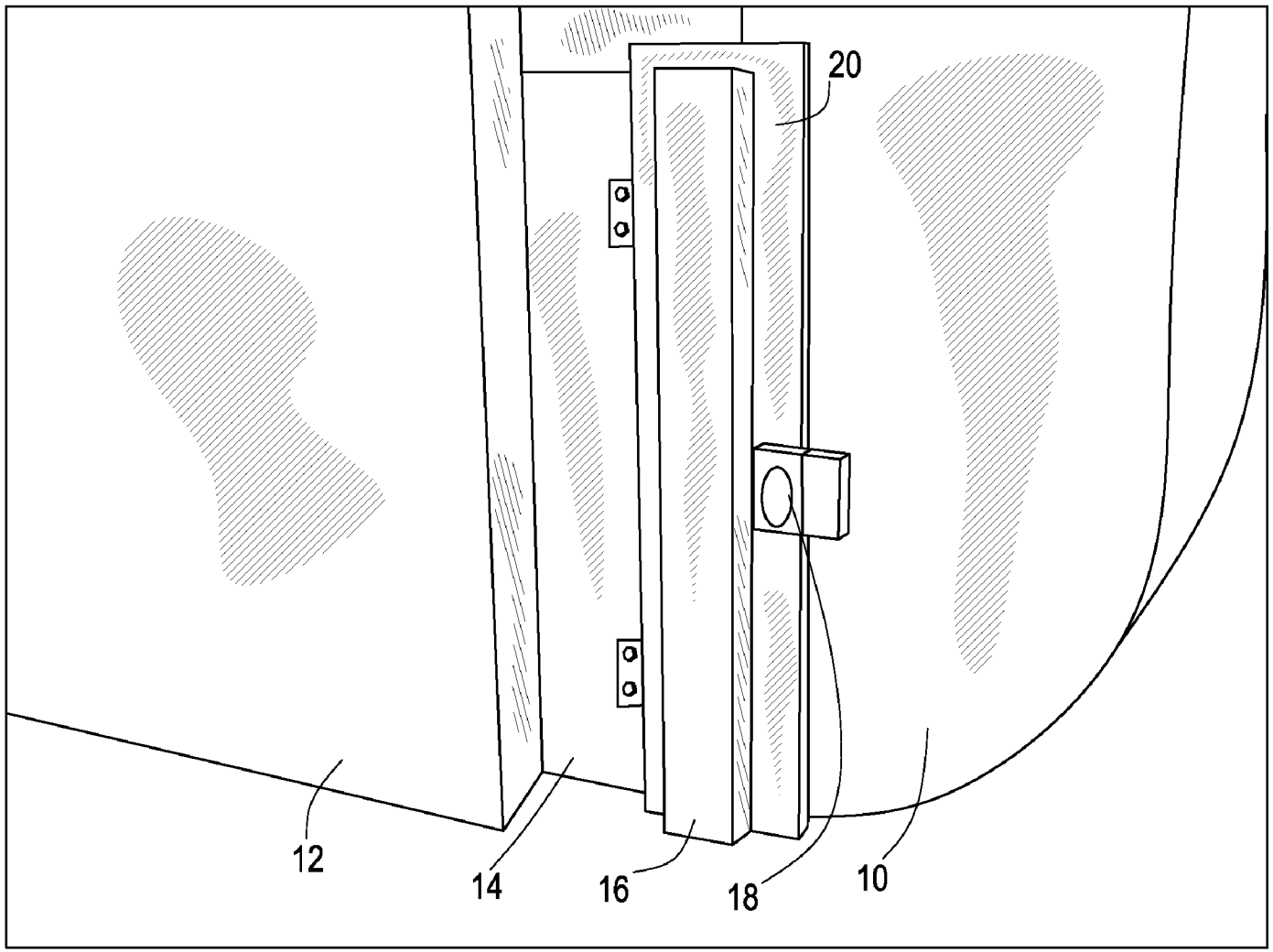
FIG. 1 is a drawing of an air filter duct cover of one embodiment of the present invention.

Referring to FIG. 1 as in one embodiment are a return duct 10 and a furnace 12 with a filter holder 14 connecting to the return duct 10 to the furnace 12. The filter holder 14 has an air filter duct cover 16. The air filter duct cover 16 has a catch 18 that secures a protruding piece cover 20 to the return duct 10.

Figure 2:
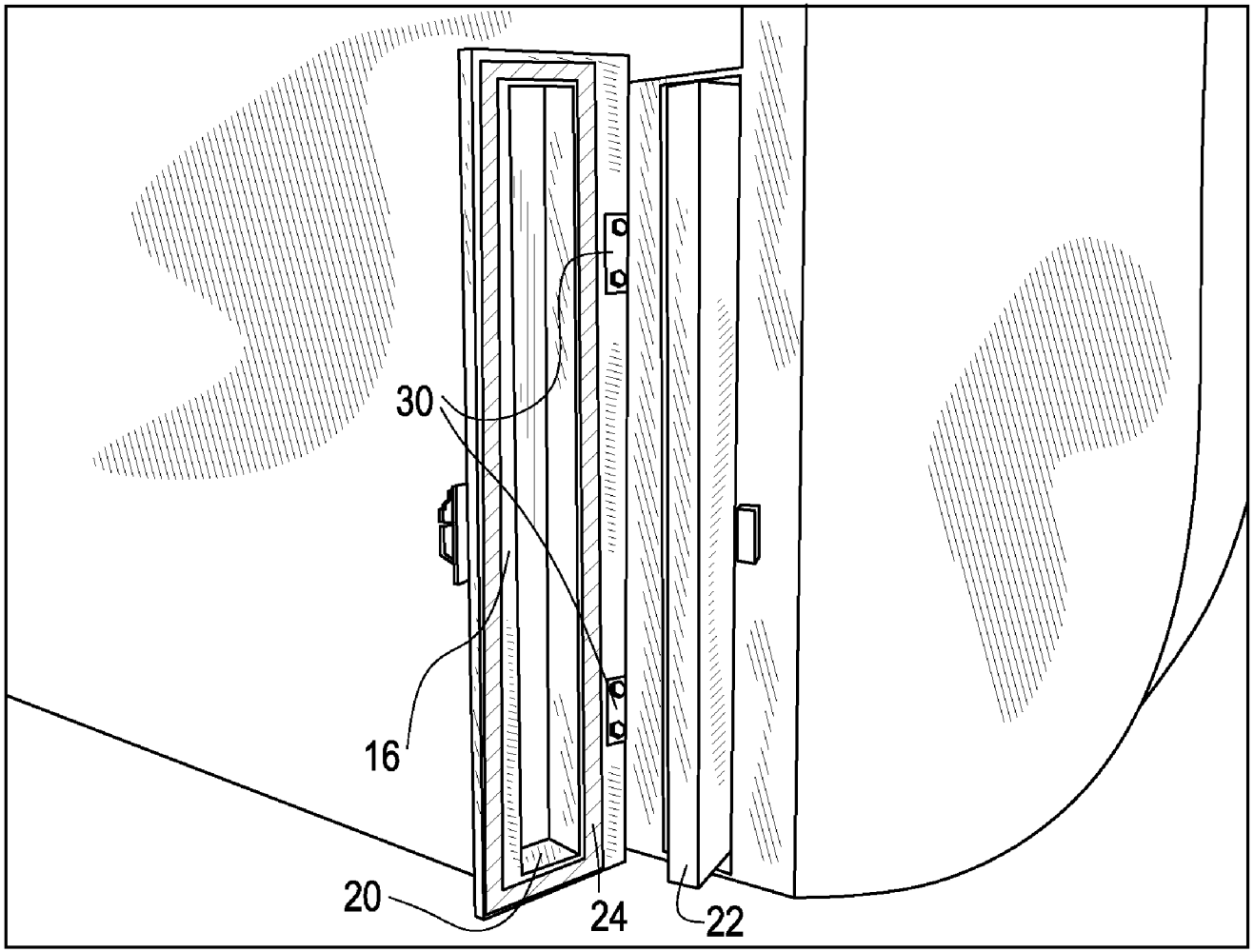
FIG. 2 is a drawing of an air filter duct cover of one embodiment of the present invention.
Figure 3B:
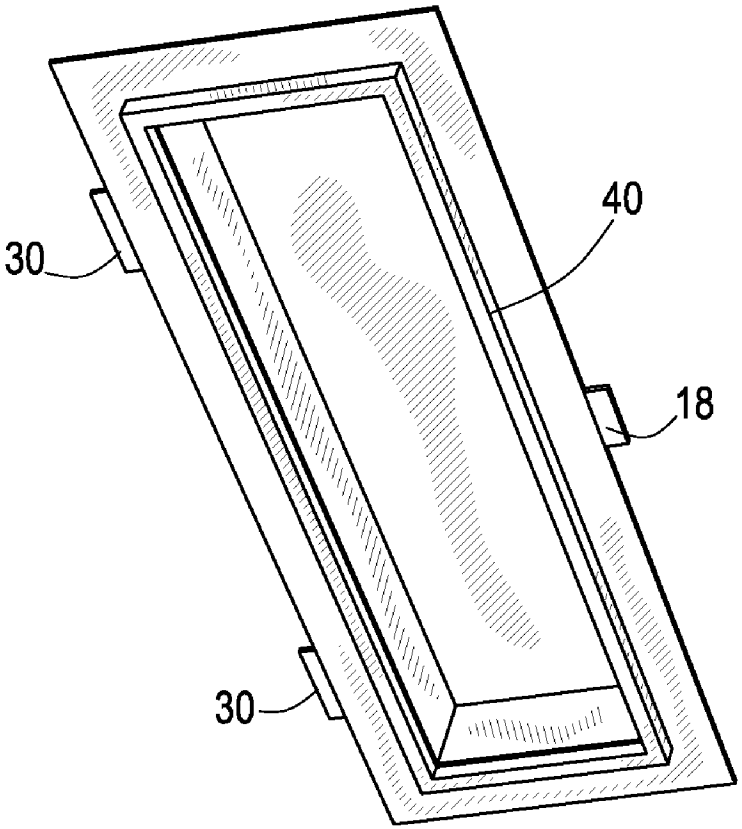
FIGS. 3*a* and 3*b* are drawings of an air filter duct cover of one embodiment of the present invention.
Figure 3A:
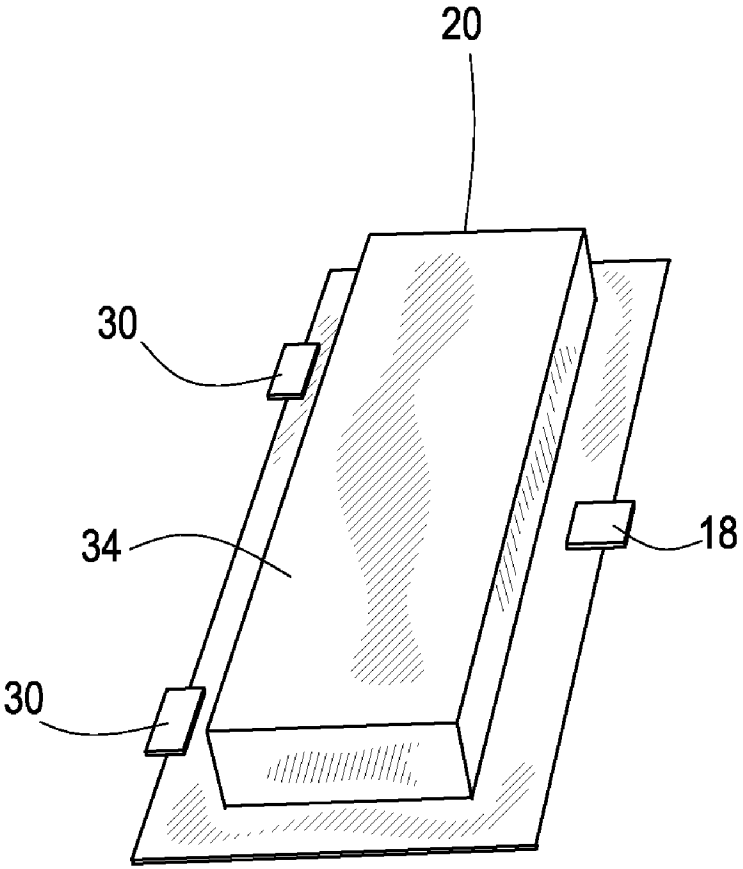
Figure 4B:
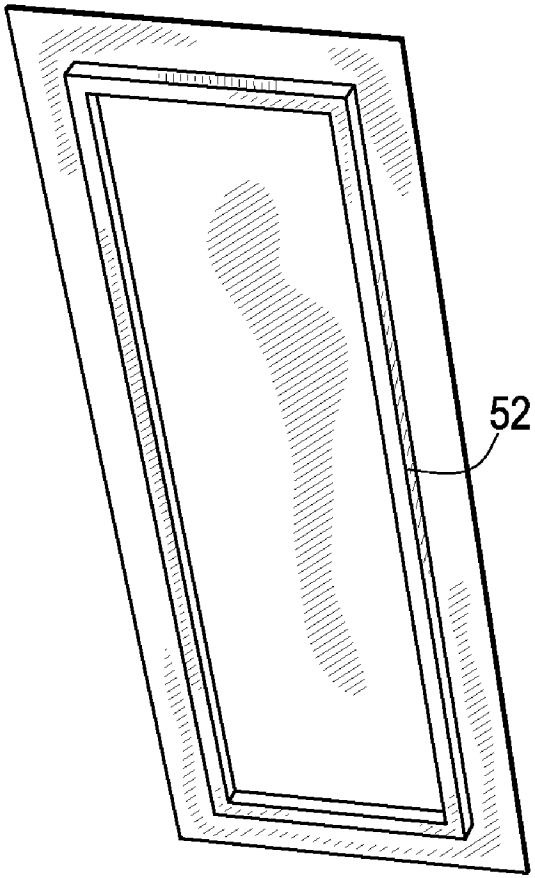
FIGS. 4*a* and 4*b* are drawings of an air filter duct cover of one embodiment of the present inventions.
Figure 4A:
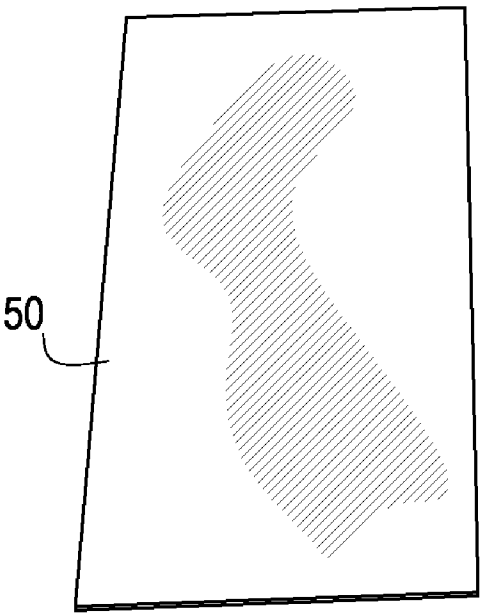
Figure 5:
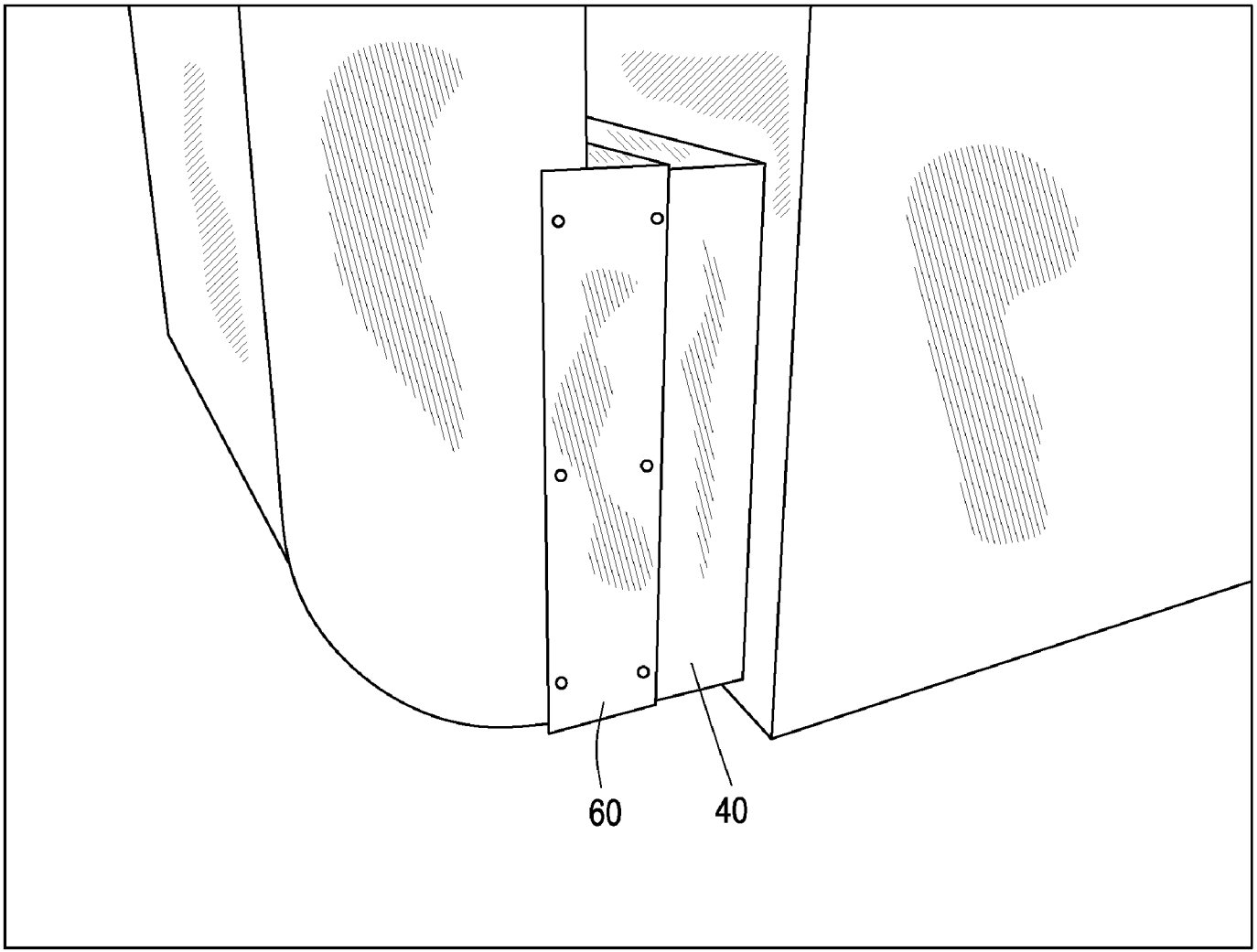
FIG. 5 is a drawing of an air filter holder of one embodiment of the present invention.

Referring to FIG. 2, as in one embodiment is the air filter duct cover 16 with the protruding piece cover 20 in an open position so you can see a filter 22. Shown is a foam seal 24 on the protruding piece cover 20 and hinges 30. Referring to FIG. 3*a*, as in one embodiment is a front view of a protruding piece cover 20 with hinges 30 and a protruding piece cover outside 34. In FIG. 3*b* as in one embodiment is a back view of a protruding piece cover 20. Shown are catch 18, hinges 30 with foam seal 40. Referring to FIGS. 4*a* and 4*b* as in one embodiment is a flat piece cover 50. Shown is a foam gasket sealer 52. Referring to FIG. 5 as in one embodiment shown is the filter holder 14 side opposite of the protruding piece cover 20, the opposite side has a fixed cover 60.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A metal air filter duct cover, comprising:

a protruding cover having a plurality of external hinges that secures the protruding cover to a return duct; a catch disposed opposite the external hinges of protruding cover that secures the protruding cover to a furnace, the catch secures the protruding cover in a closed position, the external hinges allows the protruding cover to open and close, the protruding cover goes over a filter holder opening to allow replacement of a filter;

a second part cover that screws on the return duct and filter holder to cover a second opening, the second opening is being disposed on the filter holder opposite the filter holder opening.

2. The air filter duct cover of claim 1, wherein the protruding cover is provided with a foam seal on an inside surface.

3. The air filter duct cover of claim 1, wherein the second part cover is a flat cover.

4. A metal air filter duct cover, comprising:

a protruding cover, that has at least one catch that secures the protruding cover to a return duct, the cover has a plurality of external hinges to open and close the cover over a filter holder opening to allow a filter to be exchanged.

5. The air filter duct cover of claim 4, wherein the protruding cover is provided with a foam seal on an inside surface that when secured with the catch seals the filter holder opening.

* * * * *